US009085026B2

(12) United States Patent
Mejia-Quinchia et al.

(10) Patent No.: US 9,085,026 B2
(45) Date of Patent: Jul. 21, 2015

(54) HIGH SPEED SEAMING ASSEMBLY

(75) Inventors: Carlos Andrés Mejia-Quinchia, Schaumburg, IL (US); Brian Fields, Lemont, IL (US)

(73) Assignee: Crown Packaging Technology, Inc., Alsip, IL (US)

( * ) Notice: Subject to any disclaimer, the term of this patent is extended or adjusted under 35 U.S.C. 154(b) by 942 days.

(21) Appl. No.: 13/157,639

(22) Filed: Jun. 10, 2011

(65) Prior Publication Data

US 2012/0315111 A1 Dec. 13, 2012

(51) Int. Cl.
*B21D 51/32* (2006.01)
*B21D 51/26* (2006.01)

(52) U.S. Cl.
CPC ..... *B21D 51/2653* (2013.01); *B21D 51/32* (2013.01)

(58) Field of Classification Search
CPC ..... B21D 51/2661; B21D 51/2653; B21D 51/30; B21D 51/32
USPC ..... 413/2, 4, 6, 27, 26, 36, 37, 38, 43; 72/94, 125, 379.4; 140/89
See application file for complete search history.

(56) References Cited

U.S. PATENT DOCUMENTS 3,006,304 A * 10/1961 Renzi ..... 413/37
4,470,738 A * 9/1984 Togo et al. ..... 413/37
4,961,300 A 10/1990 Mihara et al.
5,533,853 A 7/1996 Wu
5,813,812 A 9/1998 Moran et al.
5,957,647 A 9/1999 Hinton
6,065,634 A 5/2000 Brifcani et al.
6,105,341 A 8/2000 Campbell
6,516,968 B2 2/2003 Stodd
6,561,004 B1 5/2003 Neiner et al.
6,702,142 B2 3/2004 Neiner
7,350,392 B2 4/2008 Turner et al.
7,399,152 B2 7/2008 Domijan
8,328,493 B2 * 12/2012 Gogola et al. ..... 413/27
2002/0062123 A1 * 5/2002 McClurken et al. ..... 606/34
2002/0081172 A1 6/2002 Wu
2011/0008134 A1 1/2011 Fields et al.

* cited by examiner

*Primary Examiner* — Debra Sullivan
(74) *Attorney, Agent, or Firm* — Baker & Hostetler LLP

(57) ABSTRACT

A seaming assembly configured to seam a can end onto a can body to form a seamed container is disclosed. The seaming assembly includes a lifter assembly, a seaming chuck, and a knockout pad. The lifter assembly may be configured to lift a can body, and may include a spring. The seaming chuck may include a surface that is configured to contact a portion of the can end during seaming. The knockout pad may be movable relative to the seaming chuck, and may be configured to locate the can end prior to seaming. The spring may be preloaded to provide a force between 30 lbf and 90 lbf to the can body when the lifter assembly has lifted the can body and the can end has contacted the seaming chuck. The force provided to the can body may increase to between 90 lbf and 150 lbf after the spring has been compressed.

33 Claims, 7 Drawing Sheets

HIGH SPEED SEAMING ASSEMBLY

CROSS REFERENCE TO RELATED APPLICATIONS

This application is related in subject matter to U.S. patent application Ser. No. 12/498,861, filed Jul. 7, 2009.

BACKGROUND

In the field of metal packaging, typical containers are sealed by seaming a can end onto a can body using a well known double seaming process. The double seaming process is typically performed on a seaming system having a plurality of forming stations or seaming assemblies. Each assembly contains a rotatable seaming chuck that acts as an anvil to support the can body while two rotatable seaming rolls are brought into contact with the can end using a cam motion. The two seaming rolls define specific groove geometries that are configured to form a portion of the can body and a portion of the can end into a commercially acceptable double seam to thereby couple the can end to the can body.

Before the double seaming process, a can body is raised into engagement with a seaming chuck using a lifter chuck assembly or other positioning mechanism. After the double seam is formed, the positioning mechanism retracts, and the sealed container is ejected from the seaming chuck so that the seam-forming cycle can be repeated on another container. Ejection of the seamed container may be accomplished by the use of a knockout pad that taps a center panel of the container to knock the container out of engagement with the seaming chuck.

With current light-weight beverage cans, and/or with cans filled with low carbonated beverages, double-seamer speeds have been reduced to prevent can damage, such as body wrinkling. In some cases, filling speeds have been reduced to about 1150 cans per minute to avoid wrinkles in the can bodies.

SUMMARY

In one embodiment a seaming assembly configured to seam a can end onto a can body to form a seamed container is disclosed. The seaming assembly includes a lifter chuck assembly, a seaming chuck, and a knockout pad. The lifter chuck assembly is configured to lift a can body, and includes a lifter plate that is configured to support the can body, and a compression spring disposed below the lifter plate. The seaming chuck includes a drive surface that is configured to contact a portion of the can end during seaming and against which a seaming force is applied. The knockout pad is movable relative to the seaming chuck, and is configured to both locate the can end prior to seaming, and contact the can end to disengage the seamed can from the seaming chuck after seaming. In a preferred embodiment the compression spring is preloaded to provide an axial force between about 30 lbf and about 90 lbf to the can body when the lifter chuck assembly has lifted the can body and the can end has contacted the seaming chuck. The axial force provided to the can body may then increase to between about 90 lbf and about 150 lbf after the compression spring has been compressed a specified distance.

In another embodiment the seaming assembly includes a lifter chuck assembly, a seaming chuck, and a knockout pad. The lifter chuck assembly includes a lifter plate that is configured to support a can body. The seaming chuck includes a drive surface that is configured to contact a portion of the can end during seaming and against which a seaming force is applied. The knockout pad is movable relative to the seaming chuck, and is configured to locate the can end prior to seaming, and contact the can end to disengage the seamed container from the seaming chuck after seaming. The knockout pad is configured to provide a first axial force to the can end and can body prior to the can end engaging the seaming chuck. The lifter chuck assembly is configured to lift the can end and can body so that the can end engages the seaming chuck. The lifter chuck assembly is configured to provide a second axial force to the can end and can body when the can end engages the seaming chuck. The second axial force is greater than the first axial force by less than 70 lbf.

In another embodiment, a method of seaming a can end onto a can body to form a container is disclosed. The method includes positioning the can end on top of the can body to form a can body and can end combination. The can end is located with a knockout pad. The can body and can end combination is lifted with a lifter chuck assembly until the can end engages a seaming chuck. The lifter chuck assembly provides an axial force between about 30 lbf and about 90 lbf to the can body when the can end engages the seaming chuck. The can body and can end combination is further lifted with the lifter chuck assembly until the axial force provided by the lifting chuck assembly increases to between about 90 lbf and about 150 lbf to the can body. The can end is then seamed onto the can body during at least a first seaming operation.

BRIEF DESCRIPTION OF THE DRAWINGS

The foregoing summary, as well as the following detailed description of a preferred embodiment, will be better understood when read in conjunction with the appended drawings. For the purposes of illustrating the seaming assembly of the present application, there is shown in the drawings a preferred embodiment. It should be understood, however, that the application is not limited to the precise arrangements and methods shown. In the drawings.

DETAILED DESCRIPTION

Figure 1B:
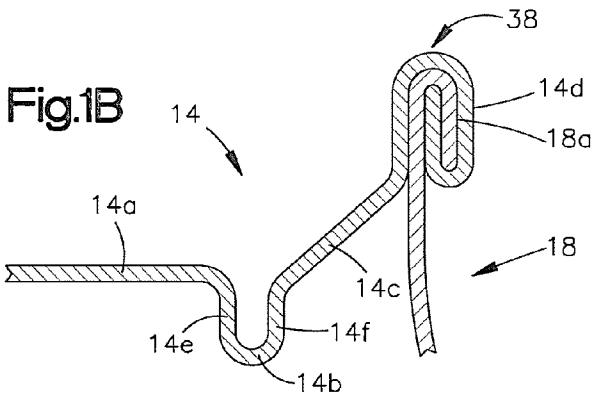
FIG. 1B is a partial cross-sectional view of a can body and a can end seamed onto the can body.
Figure 1A:
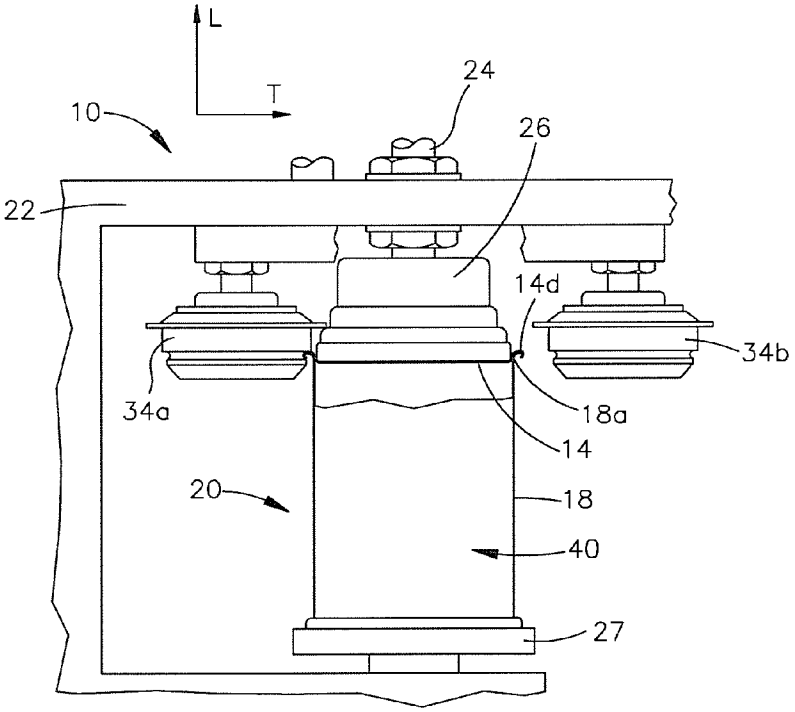
FIG. 1A is a schematic side view of a seaming assembly in accordance with an embodiment, the seaming assembly includes a chuck-knockout assembly, a lifter chuck assembly, and a pair of seaming rolls configured to seam a can end onto a can body to form a seamed container.

Referring to FIGS. 1A and 1B, a seaming assembly 10 is configured to seam a can end 14 onto a can body 18 to form a seamed container 20 ready for consumption by an end user. The seaming assembly 10 includes a frame 22, a chuck-knockout assembly 26 mounted on the frame 22 by a rotating shaft 24, and a lifter chuck assembly 27 mounted on the frame 22 vertically below the chuck-knockout assembly 26. The chuck-knockout assembly 26 includes a seaming chuck 28, and a knockout pad 30 that is movable relative to and within the seaming chuck 28 (see e.g. FIGS. 3A-3D). The lifter chuck assembly 27 is configured to support the can body 18 and can end 14 combination, and lift the combination until the can end 14 engages the seaming chuck 28 of the chuck-knockout assembly 26. The seaming assembly 10 further includes a pair of seaming rolls 34*a* and 34*b* that are configured to form a double seam 38 that seals the can end 14 onto the can body 18 via a double seaming process (e.g., bending a curl portion 14*d* of the can end 14 and a top edge 18*a* of the can body 18 as shown in FIG. 1B). This double seaming process occurs while the can end 14 is engaged with the seaming chuck 28. As shown in FIG. 1A, the chuck-knockout assembly 26 and the lifter chuck assembly 27 are aligned along a longitudinal or vertical direction L, and the pair of seaming rolls 34*a* and 34*b* are, as convention, generally aligned along a transverse or horizontal direction T.

The seaming assembly 10 may be part of a seaming system that includes at least two, such as twelve, fourteen, or eighteen seaming assemblies 10. Each seaming assembly 10 in the seaming system rotates about a center axis of the system from make up of the can end 14 and can body 18 (i.e. when the can end 14 is placed on top of the can body 18) through to discharge of the seamed container 20 and continues to rotate as it takes another can body and can end through the process. It should be understood, however, that the seaming assembly 10 may be part of a seaming system having other configurations, as desired.

The seaming assembly 10 is configured to reduce wrinkling in the can body 18 while maintaining and/or increasing throughput speeds, although the present invention is not limited to eliminating wrinkling. For example, the seaming assemblies 10 may be configured to seam a can end 14 onto a can body 18 filled with a product 40, such as a low carbonated beverage, at speeds of at least about 1250 cans/minute, preferably at least about 1350 cans/minute, and even more preferably at least about 1550 cans/minute. It should be understood, however, that the seaming assembly 10 may be used to seam a can end 14 onto a can body 18 filled with any product 40, including carbonated beverages (i.e. beer and soda), ready meals, fruits, vegetables, fish, dairy, pet food, or any other product that is desirable of being stored in metal packaging such as the container 20. It should also be understood, that the speeds provided are for seaming systems having twelve seaming assemblies 10, and that the speeds may vary depending on the number of seaming assemblies 10 on the machine.

The container 20, including the can end 14 and the can body 18 that are to be seamed together, may be made from any material, for example, steel, aluminum, or tin plate, and may include a variety of configurations. For example, as shown in FIG. 1B, the can end 14 may include an approximately circular center panel 14*a*, a substantially U-shaped countersink 14*b* extending radially outward from the center panel 14*a*, an angled chuck wall 14*c* extending radially outward from the countersink 14*b*, and a curl portion 14*d* extending radially outward from the chuck wall 14*c*. As shown in FIG. 1B, the curl portion 14*d* is configured to be wound tight with a curled top edge 18*a* of the can body 18 to form the double seam 38.

The center panel 14*a* may be formed, pressed, and/or stamped to take a shape that may include several features. For example, the can end 14 may include an openable panel portion that extends over a portion or most of the center panel 14*a*. The openable panel portion may be opened by breaking a score to create an aperture through which a user may remove the product 40. The can end 14 may also include a pull tab that is configured to open the openable panel portion upon actuation by a user to thereby provide access to the product 40 contained within the can body 18.

As shown in FIG. 1B, the countersink may be U-shaped, including an inner wall 14*e* and an outer wall 14*f*. As illustrated, the inner and outer walls 14*e* and 14*f* may be substantially vertically oriented along the longitudinal direction L. It should be understood, however, that the countersink 14*b* may include other configurations as desired. For example, the countersink 14*b* may be indented or may include a fold.

With continued reference to FIG. 1B, the chuckwall 14*c* may be angled with respect to a center axis of the can end 14 as illustrated, or may be substantially vertical. For example, the chuckwall 14*c* may be angled at an angle between about 20 degrees and about 60 degrees with respect to the center axis. Moreover, the chuckwall 14*c* may be a one-part chuckwall or a multi-part chuckwall, such as a two-part chuckwall.

Figure 2:
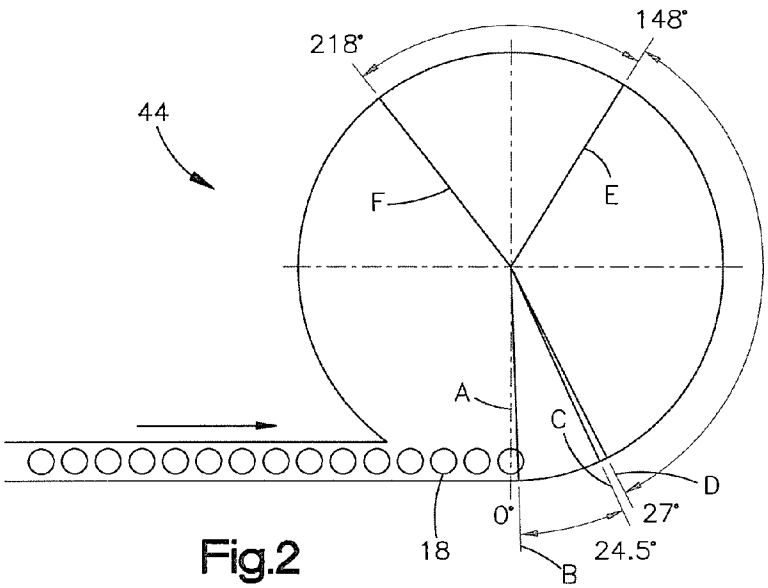
FIG. 2 is a schematic view showing different stages of a seaming operation performed by the seaming assembly shown in FIG. 1, the seaming operation including at least a transition zone.

Referring to FIG. 2, the seaming assembly 10 may seam the can end 14 onto the can body 18 using a seaming process 44. According to the seaming process 44, the can body 18 may enter the seaming assembly 10 at point A, and at point B (approximately 1 degree from point A, the can body 18 picks up the can end 14. Around two degrees from point B, the knockout pad 30 makes contact with or otherwise engages the can end 14, and locates the can end 14 and can body 18 combination. From point B to point C, which is known as the transition zone of the seaming operation 44, the can end 14 and the can body 18 combination are raised by the lifter chuck assembly 27 until the can end 14 engages the seaming chuck 28. Once the can end 14 engages the seaming chuck 28, the knockout pad 30 is raised or otherwise disengages from the can end 14. As shown in FIG. 2, the can end 14 engages the seaming chuck 28 at point C, which is about 24.5 degrees from point A. Then at point D which is about 27 degrees from point A, the first seaming operation begins, and at point E, which is about 148 degrees from point A the second seaming operation begins to thereby form the seamed container 20. The seamed container 20 is then discharged at point F which is about 218 degrees from point A. In particular, the knockout pad 30 translates downward and engages the can end 14 to thereby "knock" the container 20 out of engagement with the seaming chuck 28. It should be understood, that the seaming operation 44 is not limited to the precise steps illustrated, and that the locating of the can end 14 by the knockout pad 30 (point B), the engagement of the can end 14 with the seaming chuck 28 (point C), the first and second seaming operations (points D and E), and the discharge of the container (point F) may occur at positions relative to point A of the operation that are different than those illustrated. For example, points B-F may occur at different angles, or even along a linear assembly line or process.

Referring to FIGS. 1A, and 3A-3D, the chuck-knockout assembly 26 includes a cylindrical seaming chuck 28 and a knockout pad 30 that is translatable along the longitudinal direction L within the seaming chuck 28. The chuck-knockout assembly 26 defines a distal end D, a proximal end P, and a longitudinal center axis C that extends between the distal end D and the proximal end P. The cylindrical seaming chuck 28 is configured to rotate about the longitudinal center axis C as the seaming assembly 10 rotates about the seaming system center axis. Similarly, the knockout pad 30 is configured to rotate about the longitudinal center axis C when the knockout pad 30 engages the can end 14. When the knockout pad 30 is not in engagement with the can end 14, however, the knockout pad 30 is configured to not rotate. Therefore, the knockout pad 30 may be considered floating relative to the seaming chuck 28.

Figure 3B:
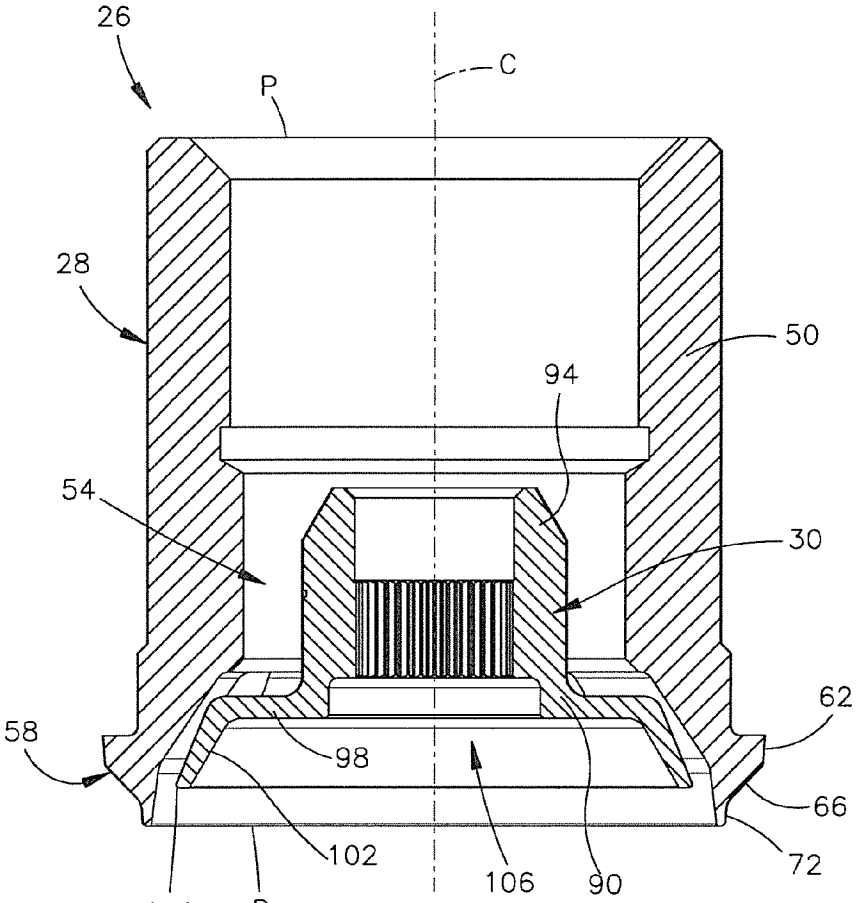
FIG. 3B is a side cross-sectional view of the chuck-knockout assembly shown in FIG. 3A.
Figure 3A:
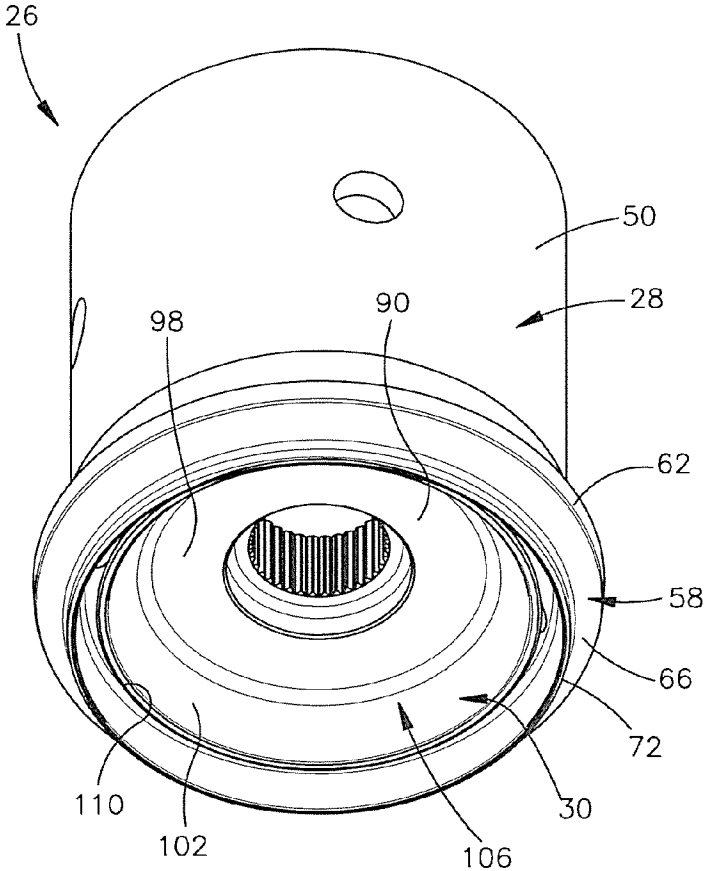
FIG. 3A is bottom perspective view of a chuck-knockout assembly according to an embodiment, the chuck-knockout assembly including a seaming chuck and a knockout pad.

As shown in FIGS. 3A and 3B, the seaming chuck 28 includes a substantially cylindrical chuck body 50 that defines an internal void or channel 54. The channel 54 is configured to provide clearance for the knockout pad 30 to translate proximally and distally without interference from the chuck body 50.

As shown in FIGS. 3A and 3B, the chuck body 50 further defines an outer drive surface 58 that is configured to contact a portion of the can end 14 during seaming and against which a seaming force is applied by the pair of seaming rolls 34*a* and 34*b*. As shown in FIG. 3B, the drive surface 58 is disposed proximate to a distal end of the chuck body 50 and may include a vertical or seaming portion 62, and a downward extending chuckwall portion 66. The seaming portion 62 is substantially vertical and provides a surface against which the curl portion 14*d* of the can end 14 may be pressed against by the seaming rolls 34*a* and 34*b* to create the double seam 38.

The chuckwall portion 66 is frusto-conical in shape and extends distally from a distal end of the seaming portion 62. The chuckwall portion 66 defines a support surface that is configured to engage and support the chuckwall 14*c* of the can end 14 when the can end 14 has been forced into engagement with the seaming chuck 28. As shown, the chuckwall portion 66 may angle towards a center axis C of the chuck-knockout assembly 26 at an angle that is substantially equal to the angle of the chuckwall 14*c* as it extends distally. It should be understood, however, that the chuckwall portion 66 may angle toward the center axis C at an angle that is different than the angle of the chuckwall 14*c*, and that other configurations may be used as desired. For example, the chuckwall portion 66 may angle toward the center axis C at an angle that is greater than the angle of the chuckwall 14*c*. Moreover, the chuckwall portions 66 are not limited to portions 66 that define a straight line in cross-section.

As shown in FIG. 3B, the illustrated embodiment of the chuck body 50 further defines a countersink engagement portion 72 that extends distally from a distal end of the chuckwall portion 66 of the drive surface 58. The countersink engagement portion 72 is configured to engage the countersink 14*b* of the can end 14 when the can end 14 has been forced into engagement with the seaming chuck 28. It should be understood, however, that the seaming chuck 28 may be completely devoid of the countersink engagement portion 72 as desired.

Figure 3C:
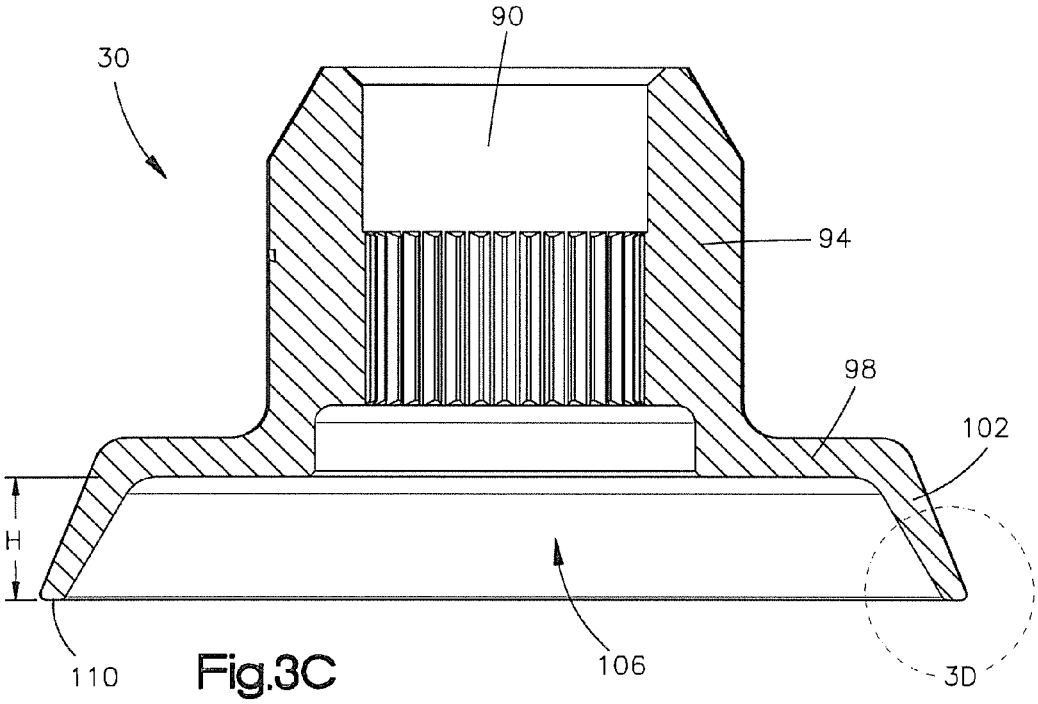
FIG. 3C is a side cross-sectional view of the knockout pad shown in FIG. 3A.
Figure 3D:
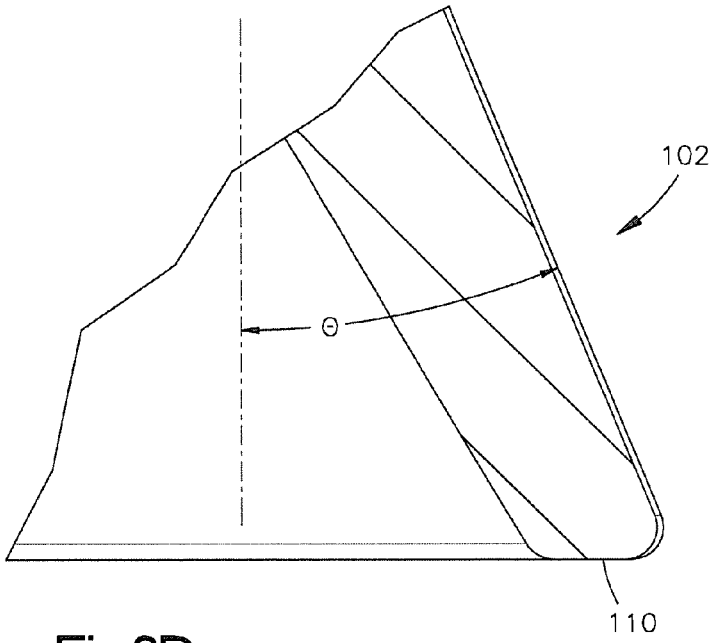
FIG. 3D is a detailed view of a downward extending portion of the knockout pad shown in FIG. 3C.

With continued reference to FIGS. 3B-3D, the knockout pad 30 includes a knockout body 90 that is translatable along the longitudinal direction L at least partially within the internal void 54 of the seaming chuck body 50. The knockout pad 30 is translatable between a lower or knockout or engaged position and an upper or seaming or disengaged position. While in the knockout position the knockout pad 30 is configured to be in engagement with the can end 14, and while in the seaming position the knockout pad 30 is configured so as to not be in engagement with the can end 14.

As shown in FIG. 3C, the knockout body 90 includes a vertically extending mount member 94, a shoulder section 98 that extends radially outward from a distal end of the mount member 94, and a downward extending section 102 that extends down from an outer end of the shoulder section 98. The shoulder section 98 and the downward extending section 102 together define a circular recessed cavity 106 that is configured to provide clearance for the tab and other features of the center panel 14*a* of the can end 14 when the knockout pad 30 is in engagement with the can end 14 (i.e. in the knockout position). As shown in FIGS. 3C and 3D, the downward extending section 102 includes a distal end 110 that defines a circle. The distal end 110 is configured to contact and locate the can end 14 during the transition zone of the seaming operation 44. The distal end 110 is also configured to contact the can end 14 so as to disengage the seamed container 20 from the seaming chuck 28 after the seaming operation has finished. The diameter of the knockout pad 30 measured at the distal end 110 of the downward extending section 102 is such that when the knockout pad 30 engages the can end 14, the distal end 110 contacts an outer periphery of the center panel 14*a* of the can end 14. Moreover, the outer diameter of the knockout pad 30 is less than the outer most diameter of the seaming chuck 28.

As shown in FIG. 3C, the downward extending section 102 may extend down from the shoulder section 98 such that the distal end 110 of the downward extending section 102 has a height, or is otherwise spaced apart from the shoulder section 98 by a distance H of at least about 0.170 inches. In the illustrated embodiment, the downward extending section 102 has a height or is otherwise spaced apart from the shoulder section 98 by a distance H of about 0.210 inches. Furthermore, the downward extending section 102 extends down from the shoulder section 98 at an angle Ø with respect to the center axis C of the chuck-knockout assembly 26. In particular, the downward extending section 102 may extend down from the shoulder section 98 at an angle Ø between about 20 degrees and 24 degrees, and even more particularly at an angle Ø of about 22.2 degrees with respect to the center axis C. As will be described, the height H of the downward extending section 102 and the angle Ø at which the downward extending section 102 extends from the shoulder section 98 allows the knockout pad 30 to better control the can end 14 and can body combination during the transition zone of the seaming operation 44.

Figure 4:
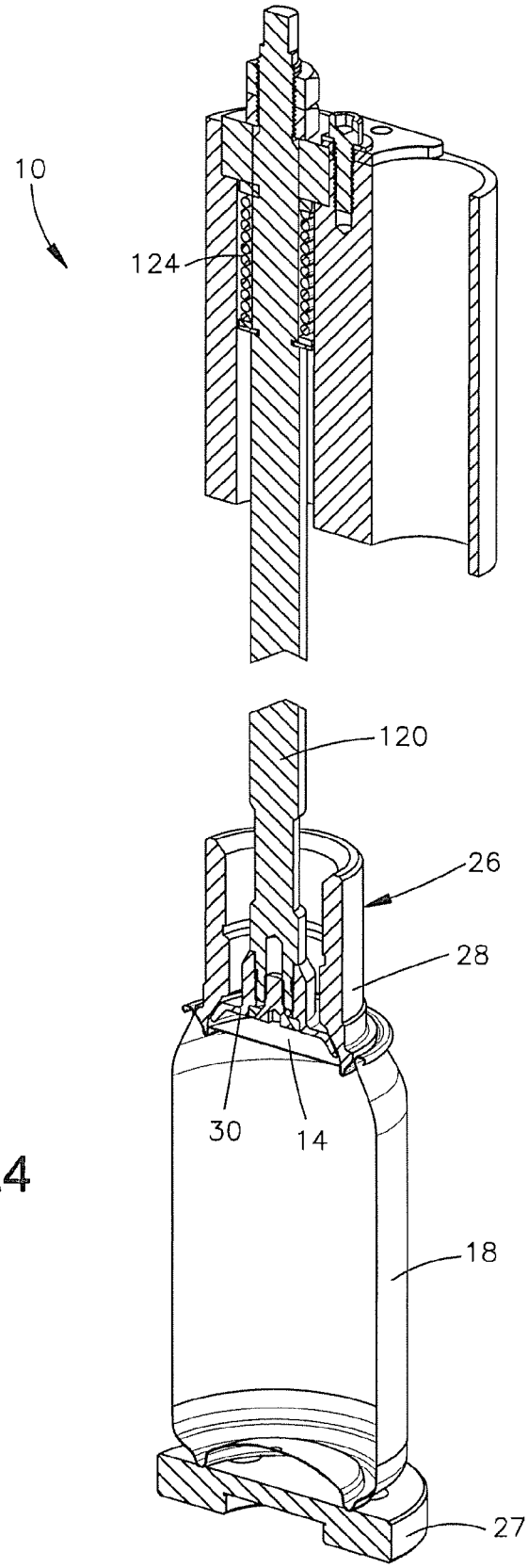
FIG. 4 is a cross-sectional perspective view of the can end and can body combination after the lifter chuck assembly has lifted the combination and the can end has engaged the seaming chuck.

As shown in FIG. 4, the chuck-knockout assembly 26 further includes a longitudinally elongate knockout rod 120 that is coupled to the knockout pad 30, and a spring 124 that is configured to apply a downward axial force or load to the can end 14. The knockout rod 120 is configured to move or otherwise translate the knockout pad 30 between the knockout position and the seaming position. The spring 124 is preloaded between about 20 lbf and about 35 lbf, and in particularly is preloaded to about 28 lbf. Moreover, the spring 124 may have a spring rate of about 45:1 lb/in. It should be understood, however, that the spring 124 may include any preload, and any spring rate as desired.

Figure 5:
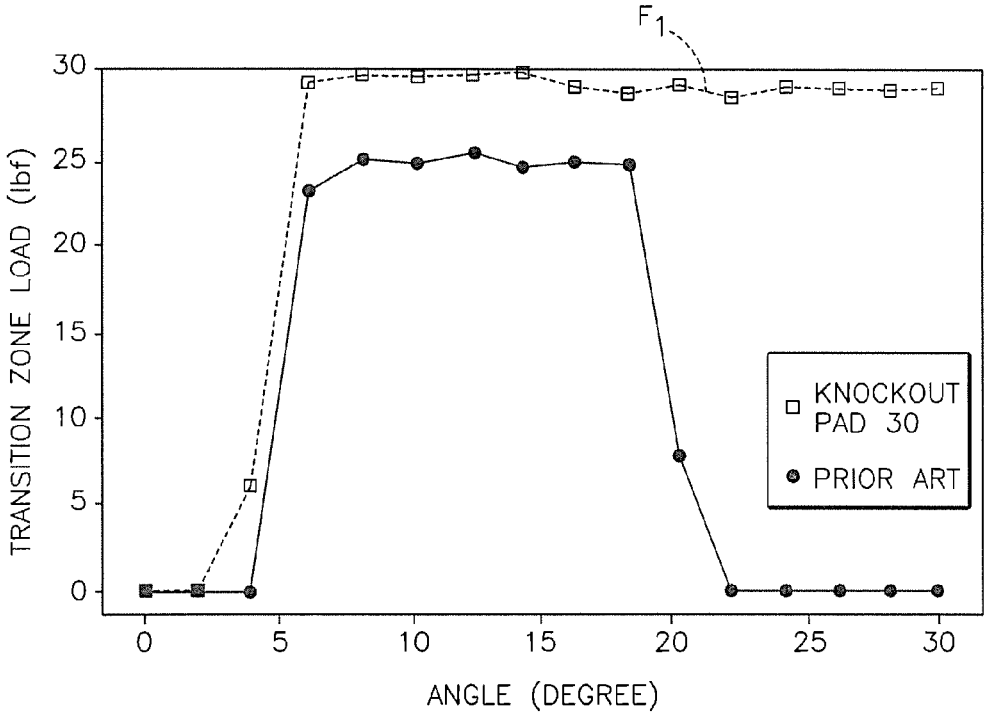
FIG. 5 is a graph showing the loads applied to the can end and can body combination by the knockout pad during at least a portion of the transition zone of the seaming operation shown in FIG. 2.

As shown in FIG. 5, the chuck knockout assembly 26, and in particular the knockout pad 30 and the spring 124, are configured to provide a sufficient first axial force $F_1$ to the can end 14 and can body 18 combination during the transition zone of the seaming operation. That is, when the knockout pad 30 is in the knockout position, and the knockout pad 30 has located the can end 14, and before the can end 14 has engaged the seaming chuck 28 (i.e. during the transition zone), the knockout pad 30 is configured to provide a first axial force $F_1$ of between about 20 lbf and about 40 lbf to the can end 14 and can body 18 combination. In the illustrated embodiment, the knockout pad 30 is configured to provide a first axial force $F_1$ of about 30 lbf to the can end 14 and can body 18 combination. As shown in FIG. 5, the knockout pad 30 is configured to apply the first axial force $F_1$ to the can end 14 and can body 18 combination for at least 70% of the transition zone, preferably at least 85% of the transition zone, and even more preferably 100% of the transition zone.

Figure 6:
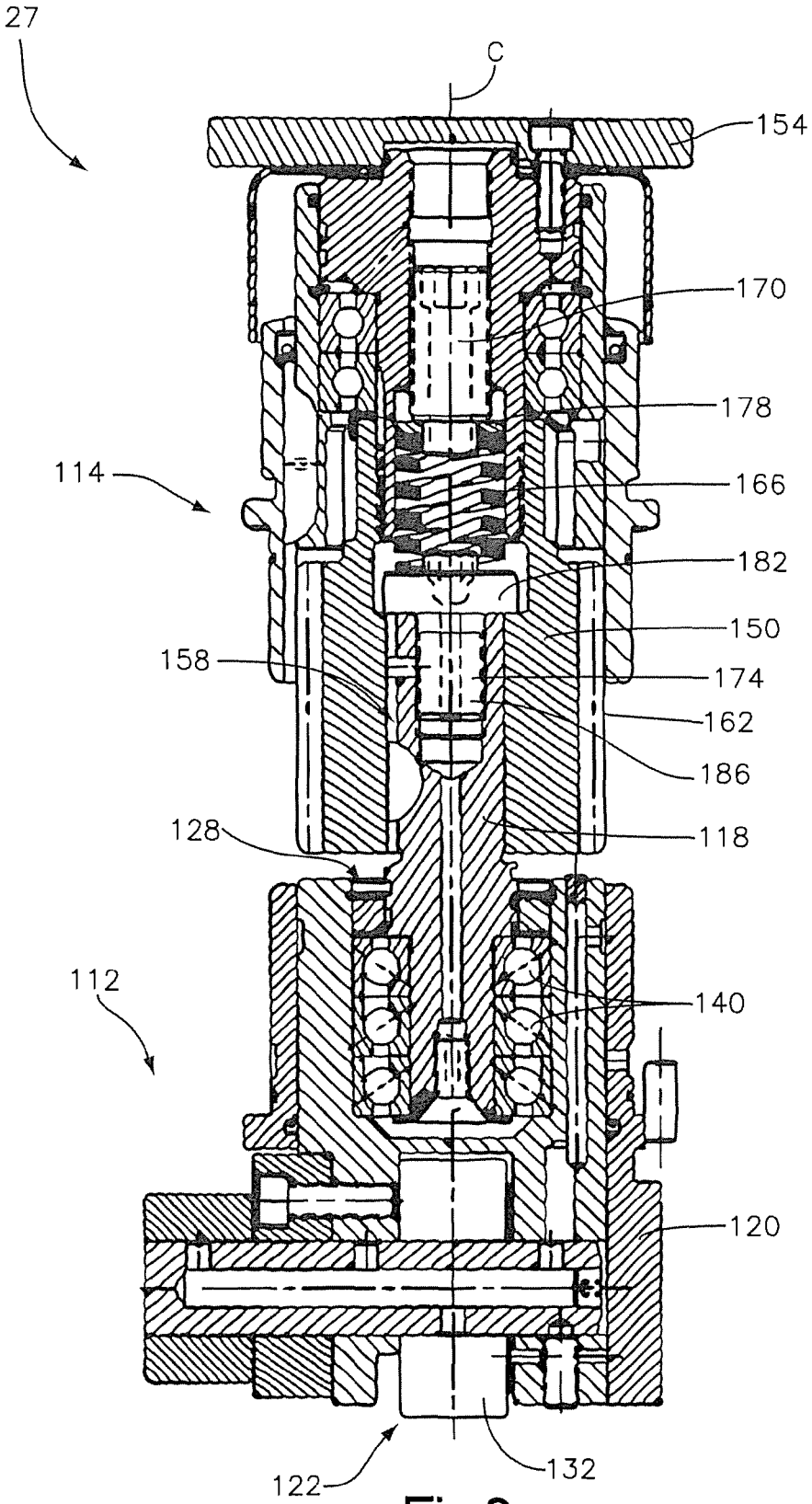
FIG. 6 is a cross-sectional side view of the lifter chuck assembly including a lifter plate, and a compression spring.

Now referring to FIG. 6, the lifter chuck assembly 27 includes a lower assembly 112, an upper assembly 114, and a lifter shaft 118 that couples the lower assembly 112 to the upper assembly 114. The lifter chuck assembly 27 is configured to translate along the longitudinal direction L between an upper or seaming position, and a lower or non-seaming position. When in the seaming position, the lifter chuck assembly 27 has lifted the can body 18 so that the can end 14 has engaged the seaming chuck 28. Therefore, the lifter chuck assembly 27 is in line with the chuck-knockout assembly 26 such that the lifter chuck assembly 27 and the chuck-knockout assembly 26 share a common longitudinal center axis C.

The lower assembly 112 includes a lower body 120 that defines a cam follower channel 122 that extends proximally into the lower body 120 from a distal end of the lower body 120, and a shaft channel 128 that extends distally into the lower body 120 from a proximal end of the lower body 120. As shown in FIG. 6, the cam follower channel 122 is configured to receive a rotating cam follower 132 that is concentric with the seaming system center axis. Therefore, as the lifter chuck assembly 27 proceeds through the seaming operation 44 or as the cam follower 132 rotates, the lower assembly 112, and thus the lifter assembly 27 will slide along the cam follower 132. The cam follower 132 is configured or includes a profile, such that as the cam follower 132 rotates on top of the lifter cam profile, the lifter assembly 27 will translate along the longitudinal direction L between the seaming position and the non-seaming position.

As shown in FIG. 6, the lifter shaft 118 is received within the shaft channel 128 such that the lifter shaft 118 extends from the lower assembly 112 and toward the upper assembly 114. In the illustrated embodiment, the lifter shaft 118 is rotatable within the shaft channel 128. In that regard, the lower assembly 112 further includes a plurality of bearings 140 within the shaft channel 128 that are configured to reduce friction within the shaft channel 128 as the lifter shaft 118 rotates.

With continued reference to FIG. 6, the upper assembly 114 includes an upper body 150 that is coupled to the lifter shaft 118, and a lifter plate 154 that is coupled to a proximal end of the upper body 150. The lifter plate 154 is configured to support a can body 18, and thus the can end 14 and can body 18 combination during the seaming operation 44. The upper body 150 defines a channel 158 that extends proximally from a distal end of the upper body 150. The channel 158 is configured to receive the lifter shaft 118 so as to couple the upper assembly 114 to the lifter shaft 118 and thus to the lower assembly 112. The upper body 150 further defines an outer gear 162 that is configured to be engaged by a second gear so as to impart rotation to the upper assembly 114 and the lifter shaft 118. Therefore, the upper assembly 114 and the lifter shaft 118 are configured to rotate about the center axis C relative to the lower assembly 112. In particular, the upper assembly 114 and the lifter shaft 118 are configured to rotate along with the seaming chuck 28, and at times with the knockout pad 30 about the center axis C.

The upper assembly 114 further includes a compression spring 166, a spring screw 170 proximal to the compression spring 166, and a bottom mandrel screw 174 distal to the spring 166, all of which are disposed within the channel 158 proximal to the lifter shaft 118. As shown, the spring screw 170 is configured to impart a force against a washer 178 that is disposed between the proximal end of the compression spring 166 and the spring screw 170 so as to provide a preload to the compression spring 166. As the spring screw 170 is tightened, the distal end of the spring 166 is compressed against the bottom mandrel screw 174. In particular, the bottom mandrel screw 174 includes a head 182, against which the spring 166 is compressed, and a shaft 186 that extends distally from the head 182. As shown, the shaft 186 of the mandrel screw 174 is coupled to the proximal end of the lifter shaft 118.

As the seaming assembly 10 rotates through the seaming process 44, the lifter chuck assembly 27 will slide along the cam follower 132 (as the cam follower 132 rotates) and lift the can body 18 until the can end 14 contacts or otherwise engage the seaming chuck 28. The lifter chuck assembly 27 is configured to provide a second axial force $F_2$ to the lifter plate 154 and thus the can end 14 and can body 18 combination when the can end 14 has engaged the seaming chuck 28. As the lifter chuck assembly 27 continues to slide along the cam follower 132, the lifter chuck assembly 27 will continue to translate upwards. However, because the can end 14 has already engaged the seaming chuck 28, the compression spring 166 will compress or otherwise the upper assembly 114 will translate along the lifter shaft 118 toward the lower assembly 112. As the lower assembly 112 translates toward the upper assembly 114, the spring 166 will compress a specified distance to thereby increase the second axial force $F_2$ provided the can end 14 and can body 18 combination. The specified distance that the spring 166 compresses may be between about 0.025 inches and about 0.045 inches, and is preferably about 0.035 inches.

Figure 7A:
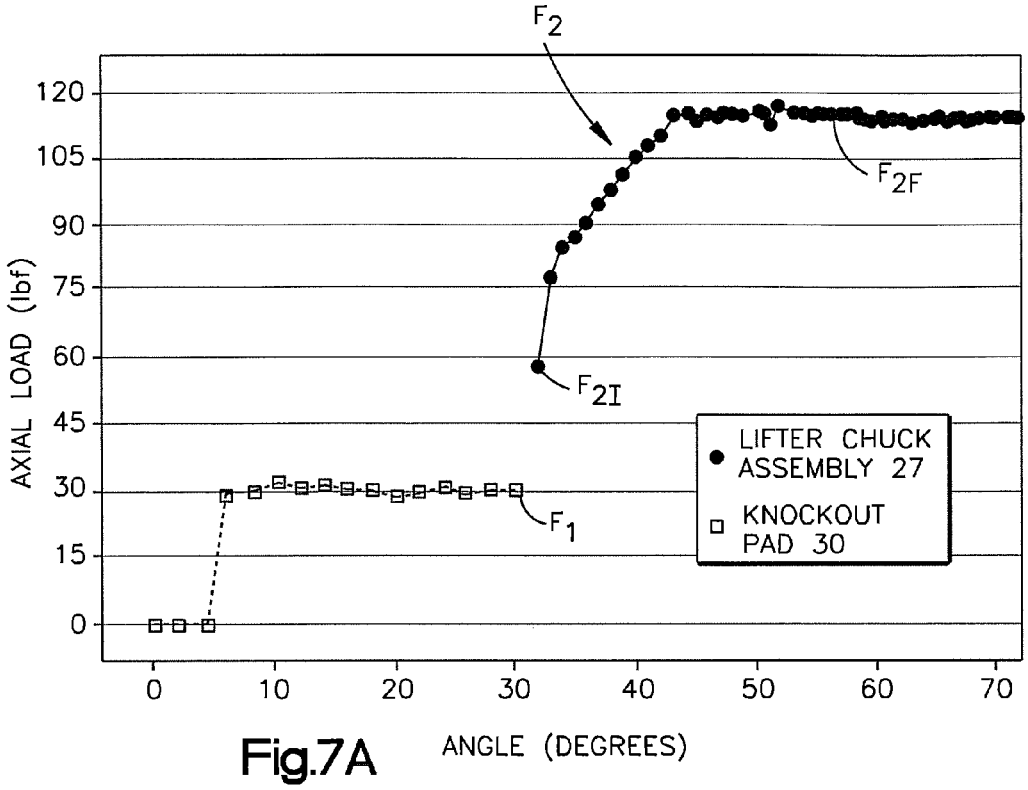
FIG. 7A is a graph showing the transition force on the can end and can body combination after the lifter chuck assembly has lifted the combination, and the can end has engaged the seaming chuck.

The compression spring 166 may have a spring rate of about 1600 lb/in and is preloaded to provide an initial second axial force $F_{2I}$ between about 30 lbf and about 90 lbf to the can end 14 and can body 18 combination when the lifter chuck assembly 27 has lifted the can body 18 and the can end 14 has contacted or otherwise engaged the seaming chuck 28. In the illustrated embodiment and as shown in FIG. 7A, the compression spring 166 is preloaded to provide an initial second axial force $F_{2I}$ of about 54 lbf to the can end 14 and can body 18 combination when the lifter chuck assembly 27 has lifted the can body 18 and the can end 14 has engaged the seaming chuck 28. The compression spring 166 is also configured such that as the spring 166 compresses the specified distance, the second axial force $F_2$ provided to the can end 14 and can body 18 combination increases to a final second axial force $F_{2F}$ that is between about 90 lbf and about 150 lbf. In the illustrated embodiment, and as shown in FIG. 7A, the spring 166 is configured such that the final second axial force $F_{2F}$ provided to the can end 14 and can body 18 combination after the compression spring 166 has compressed the specified distance is about 110 lbf or about 120 lbf as desired. It should be understood, however, that the compression spring 166 may include any preload, and any spring rate to achieve a desired result.

Figure 7B:
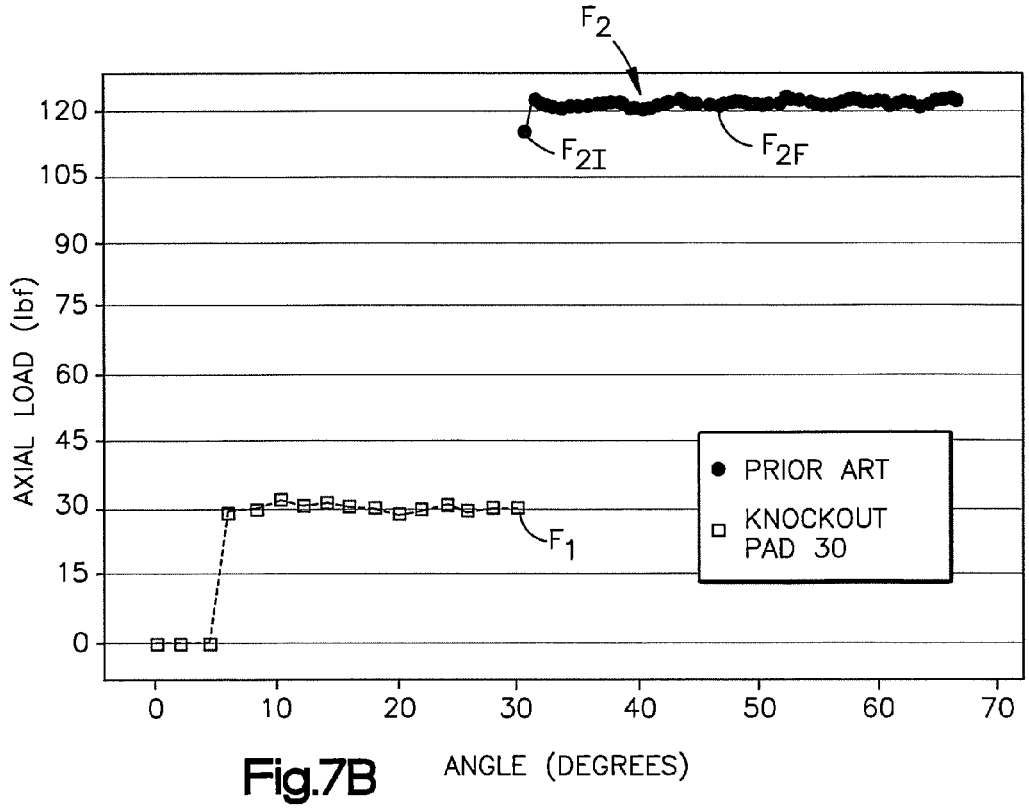
FIG. 7B is a graph showing the transition force on the can end and can body combination after an example prior art lifter assembly has lifted the combination, and the can end has engaged the seaming chuck.

In further reference to FIGS. 7A and 7B, the lifter chuck assembly 27 is configured to provide a lower transition force when the can end 14 engages the seaming chuck 28, as compared to prior lifter chuck assemblies. In that regard, the knockout pad 30 will provide the first axial force $F_1$ to the can body 18 during a majority of the transition zone. When the lifter chuck assembly 27 lifts the can body 18 and the can end 14 engages the seaming chuck 28, the knockout pad 30 will disengage the can end 14, and the can body 18 will experience the initial second axial force $F_{2I}$ provided by the lifter chuck assembly 27. The difference between the first axial force $F_1$ provided by the knockout pad 30 and the initial second axial force $F_{2I}$ is considered to be the transition force, which is less than 70 lbf, and preferably is less than 35 lbf. In the illustrated embodiment, the knockout pad 30 provides a first axial force $F_1$ of about 30 lbf, and the lifter chuck assembly provides an initial second axial force $F_{2I}$ of about 54 lbf. Therefore, the transition force of the illustrated seaming assembly 10 is about 24 lbf.

Now referring to FIG. 7B, a seaming assembly 10 including an example prior art lifter chuck assembly, produces a transition force of about 85 lbf, which is significantly greater than the transition force provided by a seaming assembly 10 that includes the lifter chuck assembly 27. It should be understood, however, that while the graphs of FIGS. 7A and 7B show data compiled with a seaming assembly 10 that utilizes a knockout pad 30 in combination with either the example prior art lifter chuck assembly or the disclosed lifter chuck assembly 27, other variations of the lifter chuck assembly 27 as appreciated by those skilled in the art may be configured to achieve the lower transition forces. Moreover, it should be appreciated that the data shown in FIGS. 7A and 7B was collected using an Angelus 120L and 121L seaming system, commercially available from Pneumatic Scale Angelus headquartered in Stow, Ohio, and that the prior art lifter chuck assembly that produced the data shown in FIG. 7B is the lifter chuck assembly currently used on the Angelus 120L seaming system.

In operation, a filled can body 18 enters the seaming assembly 10 and a can end 14 is placed on top of the can body 18 which is known as make up. The knockout pad 30 will translate to the knockout position and locate the can end 14. Once located, the knockout pad 30 will provide the first axial force $F_1$ to the can end 14 and can body 18 combination, which in the illustrated embodiment is about 30 lbf. Such an axial force will help control the can end 14 and can body 18 combination so as to reduce among other things the likelihood of wrinkles being formed in the can body 18. The knockout pad 30 will continue to provide the first axial force $F_1$ for a major portion (preferably 100%) of the transition zone. At the end of the transition zone, the lifter chuck assembly 27 will translate to its seaming position so as to lift the can body 18 until the can end 14 engages the seaming chuck 28. At this point, the knockout pad 30 will disengage the can end 14, and the lifter chuck assembly 27 will provide the initial second axial force $F_{2I}$ to the can end 14 and can body 18 combination which in the illustrated embodiment is about 24 lbf greater than the first axial force $F_1$ provided by the knockout pad 30. As with control provided by the knockout pad 30, the lower transition force provided by the lifter chuck assembly 27 will help reduce among other things the likelihood of wrinkles being formed in the can body 18. The lifter chuck assembly 27 will continue to translate toward the chuck-knockout assembly 26 until the spring 166 of the lifter chuck assembly 27 is compressed the specified distance, which in the illustrated embodiment is 0.035 inches. Compression of the spring 166 will increase the second axial force $F_2$ until it reaches the final second axial force $F_{2F}$, which in the illustrated embodiment is about 110 lbf.

While the can end 14 is engaged with the seaming chuck 28, the first and second seaming rolls 34*a* and 34*b* will seam the can end 14 onto the can body 18 to form the seamed container 20. Once seamed, the knockout pad 30 may once again translate to its knockout position to thereby disengage the container 20 from the seaming chuck 28. This process is then repeated as many times as desired.

The seaming assembly 10 illustrated is configured to seam a can end shown in U.S. Pat. No. 6,065,634 onto the can body 18. The seaming assembly 10, however, is not limited to use with this particular can end 14. For example, the seaming assembly 10 may be employed to seam ends shown in U.S. Pat. Nos. 6,702,142, 6,516,968 and 7,350,392 or their commercial embodiments on to the can body 18. The disclosures of each of these patents are incorporated by reference herein in their entireties. Moreover, the seaming assembly 10 is not limited to use with beverage containers. The particular configuration of the seaming assembly 10 for these and other ends will be clear to persons familiar with these other can end configurations. For example, the drive surface of the seaming chuck 28 may include a curved chuckwall portion that drives in or proximate to a knee or junction between the can end chuck wall portions in circumstances in which the end chuck wall is a multiple-part chuck wall.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes can be made without departing from the scope and spirit of the invention as defined by the appended claims. Furthermore, any features of one described embodiment can be applicable to the other embodiments described herein.

What is claimed:

1. A seaming assembly configured to seam a can end onto a can body to form a seamed container, the seaming assembly comprising:

a lifter chuck assembly that is configured to lift a can body, the lifter chuck assembly including a lifter plate that is configured to support the can body, and a compression spring disposed below the lifter plate;

a seaming chuck including a drive surface that is configured to contact a portion of the can end during seaming and against which a seaming force is applied; and a knockout pad that is movable relative to the seaming chuck, the knockout pad is configured to (i) locate the can end and maintain engagement with the can end up until immediately after the can end engages the seaming chuck, and (ii) contact the can end to disengage the seamed can from the seaming chuck after seaming, wherein (i) the compression spring is preloaded to provide an axial force between about 30 lbf and about 90 lbf to the can body when the lifter chuck assembly has lifted the can body and the can end has contacted the seaming chuck, and (ii) the compression spring is preloaded such that the axial force provided to the can body during both a first seaming operation and a second seaming operation increases to between about 90 lbf and about 150 lbf after the compression spring has been compressed a specified distance.

2. The seaming assembly according to claim 1, wherein the compression spring is preloaded to provide an axial force of about 54 lbf to the can body when the lifter chuck assembly has lifted the can body and the can end has contacted the seaming chuck.

3. The seaming assembly according to claim 1, wherein the specified distance is about 0.035 inches.

4. The seaming assembly according to claim 1, wherein the axial force is about 110 lbf after the compression spring has been compressed the specified distance.

5. The seaming assembly according to claim 1, wherein the knockout pad provides an axial force of about 30 lbs to the can body after the knockout pad locates the can end and before the can end engages the seaming chuck.

6. The seaming assembly according to claim 5, wherein the knockout pad is configured to disengage the can end when the can end engages the seaming chuck.

7. The seaming assembly according to claim 1, wherein the knockout pad is configured to maintain an axial load that is between about 20 lbf and about 40 lbf on the can body for at least 70% of a time from when the knockout pad locates the can end to a time when the can end engages the seaming chuck.

8. The seaming assembly according to claim 1, wherein the knockout pad includes a downward extending section that is configured to contact and locate the can end, the downward extending section having a height that is at least 0.170 inches.

9. The seaming assembly according to claim 8, wherein the downward extending section has a height of about 0.210 inches.

10. The seaming assembly according to claim 8, wherein the downward extending section extends down at an angle of about 22.2 degrees with respect to a center axis of the knockout pad.

11. The seaming assembly according to claim 10, wherein a distal end of the downward extending section defines a circle.

12. The seaming assembly according to claim 1, wherein the compression spring is preloaded (i) to provide an axial force between about 30 lbf and about 90 lbf to the can body when the lifter chuck assembly has lifted the can body and the can end has contacted the seaming chuck, and (ii) such that the axial force provided to the can body increases to between about 90 lbf and about 150 lbf after the compression spring has been compressed a specified distance in order to minimize wrinkles formed in the can body.

13. A seaming assembly configured to seam a can end onto a can body to form a seamed container, the seaming assembly comprising:

a lifter chuck assembly including a lifter plate that is configured to support a can body;

a seaming chuck including a drive surface that is configured to contact a portion of the can end during seaming and against which a seaming force is applied; and a knockout pad that is movable relative to the seaming chuck, the knockout pad is configured to (i) locate the can end and maintain engagement with the can end up until immediately after the can end engages the seaming chuck, and (ii) contact the can end to disengage the seamed container from the seaming chuck after seaming, wherein (i) the knockout pad is configured to provide a first axial force to the can end and can body prior to the can end engaging the seaming chuck, (ii) the lifter chuck assembly is configured to lift the can end and can body so that the can end engages the seaming chuck, and (iii) the lifter chuck assembly is configured to provide a second axial force during both a first seaming operation and a second seaming operation to the can end and can body when the can end engages the seaming chuck, the second axial force is greater than the first axial force by less than 70 lbf.

14. The seaming assembly according to claim 13, wherein the second axial force is greater than the first axial force by less than 35 lbf.

15. The seaming assembly according to claim 13, wherein the lifter chuck assembly further includes a compression spring that is configured to apply the second axial force to the can end and can body.

16. The seaming assembly according to claim 15, wherein the compression spring is preloaded such that the second axial force is between about 30 lbf and about 90 lbf when the can end contacts the seaming chuck, and increases to between about 90 lbf and about 150 lbf after the spring has been compressed a specified distance.

17. The seaming assembly according to claim 16, wherein the second axial force is about 54 lbf when the can end engages the seaming chuck.

18. The seaming assembly according to claim 16, wherein the specified distance is about 0.035 inches.

19. The seaming assembly according to claim 16, wherein the second axial force is about 110 lbf after the compression spring has been compressed the specified distance.

20. The seaming assembly according to claim 13, wherein the first axial force is about 30 lbs after the knockout pad locates the can end.

21. The seaming assembly according to claim 20, end engages the seaming chuck.

22. The seaming assembly according to claim 13, wherein the knockout pad and the lifter chuck assembly are configured to maintain an axial load that is between about 15 lbf and about 100 lbf on the can end and can body for at least 70% of a time from when the knockout pad locates the can end to a time when the can end engages the seaming chuck.

23. The seaming assembly according to claim 13, wherein the knockout pad includes a downward extending section that is configured to contact and locate the can end, the downward extending section having a height that is at least 0.170 inches.

24. The seaming assembly according to claim 23, wherein the downward extending section has a height of about 0.210 inches.

25. The seaming assembly according to claim 23, wherein the downward extending section extends down at angle of about 22.2 degrees with respect to a center axis of the knockout pad.

26. The seaming assembly according to claim 25, wherein a distal end of the downward extending section defines a circle.

27. The seaming assembly according to claim 13, wherein the second axial force is greater than the first axial force by less than 70 lbf in order to minimize wrinkles formed in the can body.

28. A method of seaming a can end onto a can body to form a container, the method comprising:

positioning the can end on top of the can body to form a can body and can end combination;

locating the can end with a knockout pad;

lifting the can body and can end combination with a lifter chuck assembly until the can end engages a seaming chuck, the lifter chuck assembly providing an axial force between about 30 lbf and about 90 lbf to the can body when the can end engages the seaming chuck;

lifting the can body and can end combination with the lifter chuck assembly until the axial force provided by the lifting chuck assembly increases to between about 90 lbf and about 150 lbf to the can body; and after lifting the can body and can end combination with the lifter chuck assembly until the axial force provided by the lifting chuck assembly increases to between about 90 lbf and about 150 lbf to the can body, seaming the can end onto the can body during a first seaming operation and a second seaming operation.

29. The method according to claim 28, wherein the knockout pad locates the can end such that the knockout pad provides a force between about 20 lbf and about 40 lbf to the can body.

30. The method according to claim 29, wherein the knockout pad remains in contact with the can end until immediately after the can end engages with the seaming chuck.

31. The method according to claim 28, wherein the step of lifting the can body and can end combination with the lifter chuck assembly occurs after the can end engages the seaming chuck.

32. The method according to claim 28, wherein the lifting steps minimize wrinkles in the can body formed during the method.

33. The method according to claim 28, wherein the step of lifting the can body and can end combination with a lifter chuck assembly until the can end engages a seaming chuck includes the lifter chuck assembly providing an axial force of about 54 lbf to the can body when the can end engages the seaming chuck.

* * * * *